US012788170B2

(12) United States Patent
St. Amant et al.

(10) Patent No.: US 12,788,170 B2
(45) Date of Patent: Nov. 10, 2026

(54) TWO-PIECE MATS WITH DETACHABLE COVER AND BASE PAD PORTIONS

(71) Applicant: Ruggable LLC, Gardena, CA (US)

(72) Inventors: William Stanhope St. Amant, Venice, CA (US); Jayson Yagi, Santa Ana, CA (US); Robert Westphal Vera, New York, NY (US)

(73) Assignee: Ruggable LLC, Gardena, CA (US)

( * ) Notice: Subject to any disclaimer, the term of this patent is extended or adjusted under 35 U.S.C. 154(b) by 133 days.

(21) Appl. No.: 18/264,246

(22) PCT Filed: Feb. 2, 2022

(86) PCT No.: PCT/US2022/014838
§ 371 (c)(1),
(2) Date: Aug. 3, 2023

(87) PCT Pub. No.: WO2022/169802
PCT Pub. Date: Aug. 11, 2022

(65) Prior Publication Data

US 2024/0315476 A1 Sep. 26, 2024

Related U.S. Application Data

(60) Provisional application No. 63/145,776, filed on Feb. 4, 2021.

(51) Int. Cl.
*A47G 27/04* (2006.01)
*A47G 27/02* (2006.01)

(52) U.S. Cl.
CPC ..... *A47G 27/0418* (2013.01); *A47G 27/0225* (2013.01)

(58) Field of Classification Search
CPC ..... A47G 27/0418; A47G 27/0225
See application file for complete search history.

(56) References Cited

U.S. PATENT DOCUMENTS 2,721,818 A 10/1955 Dolnick et al.
2,975,089 A 3/1961 Hacking
(Continued)

FOREIGN PATENT DOCUMENTS

EP 0177664 A1 4/1986
FR 2792820 A1 11/2000
(Continued)

OTHER PUBLICATIONS amazon.com: "PetSafe Replacement Grass for Piddle Place Indoor Dog Potty Training System—Eco-friendly Alternative to Puppy Pads or Dog Pee Pads—Speedy Drainage, Easy-to-Clean, Machine-Washable, Gentle on Paws (PetSafe Store)," Feb. 17, 2012, Retrieved from URL: https://www.amazon.com/PetSafe-Piddle-Place-Potty-Replacement/dp/B007AJ2WPK.
(Continued)

*Primary Examiner* — Brian E Glessner
(74) *Attorney, Agent, or Firm* — Meunier Carlin & Curfman LLC

(57) ABSTRACT

A mat comprises a cover detachably fastened to a base pad, where the cover may be removed for washing and/or replacement. The cover may be made of a durable fabric while the base pad may be made of rubber or similar material. The base pad may comprise a number of holes through each of which a two-part fastener may be attached. A portion of hook and loop material (or another type of material intended to attach tightly to the cover) may be affixed to the portions of the fasteners oriented toward the cover so as to enable the mat to be detachably fastened to the cover.

3 Claims, 8 Drawing Sheets

(56) References Cited

U.S. PATENT DOCUMENTS

| | | | | |
|---|---|---|---|---|
| 4,018,260 | A | 4/1977 | Baslow | |
| 4,053,008 | A | 10/1977 | Baslow | |
| 4,137,584 | A | 2/1979 | Sharber | |
| 4,151,762 | A | 5/1979 | Baslow | |
| 4,161,977 | A | 7/1979 | Baslow | |
| 4,189,880 | A | 2/1980 | Ballin | |
| 4,197,686 | A | 4/1980 | Baslow | |
| 4,336,293 | A | 6/1982 | Eiden | |
| 4,348,447 | A | 9/1982 | Miller, Jr. et al. | |
| 4,504,537 | A | 3/1985 | Mussallem, Jr. | |
| 4,596,729 | A | 6/1986 | Morrison | |
| 4,709,430 | A | 12/1987 | Nicoll | |
| 4,726,084 | A | 2/1988 | Keserovich et al. | |
| 4,762,741 | A | 8/1988 | Hedley | |
| 4,860,777 | A | 8/1989 | Orlando | |
| 4,999,866 | A | 3/1991 | Lindsey | |
| 5,117,598 | A | 6/1992 | Livingston et al. | |
| 5,154,961 | A | 10/1992 | Reuben | |
| 5,195,857 | A * | 3/1993 | Hiramoto | F16B 21/086 411/173 |
| 5,203,041 | A | 4/1993 | Alonso | |
| 5,214,892 | A | 6/1993 | Livingston et al. | |
| 5,236,753 | A | 8/1993 | Gaggero et al. | |
| 5,362,544 | A | 11/1994 | Reuben | |
| 5,473,785 | A | 12/1995 | Lager et al. | |
| 5,592,721 | A | 1/1997 | Zeller | |
| 5,620,546 | A | 4/1997 | Reuben | |
| 5,711,336 | A | 1/1998 | Nirmel | |
| 5,715,638 | A | 2/1998 | Anderson, Sr. | |
| 5,763,040 | A | 6/1998 | Murphy et al. | |
| 5,775,859 | A * | 7/1998 | Anscher | F16B 5/065 411/509 |
| 5,787,527 | A | 8/1998 | Anderson | |
| 5,942,311 | A | 8/1999 | Scianna | |
| 5,953,873 | A | 9/1999 | Livingston et al. | |
| 5,997,995 | A | 12/1999 | Scianna | |
| 6,027,781 | A | 2/2000 | Landry et al. | |
| RE36,677 | E | 5/2000 | Reuben | |
| 6,065,164 | A | 5/2000 | Swanger et al. | |
| 6,114,002 | A | 9/2000 | Rinaldo | |
| 6,200,662 | B1 | 3/2001 | Mussallem, III | |
| 6,224,962 | B1 | 5/2001 | Young, III | |
| 6,238,765 | B1 * | 5/2001 | Bailey | B60N 3/046 428/95 |
| 6,399,181 | B1 | 6/2002 | Corder | |
| 6,408,461 | B2 | 6/2002 | Zheng | |
| 6,412,142 | B1 * | 7/2002 | Iverson | B60N 3/046 16/6 |
| 6,450,886 | B1 | 9/2002 | Oishi et al. | |
| 6,497,003 | B2 * | 12/2002 | Calabrese | B60N 3/046 296/97.23 |
| 6,576,577 | B1 | 6/2003 | Garner | |
| 6,610,382 | B1 | 8/2003 | Kobe et al. | |
| 6,613,113 | B2 | 9/2003 | Minick et al. | |
| 6,663,537 | B2 | 12/2003 | McCoy | |
| 6,751,816 | B1 | 6/2004 | Wechsler | |
| 6,920,655 | B2 | 7/2005 | Mitchell | |
| 6,961,969 | B2 | 11/2005 | Nichols | |
| 7,001,318 | B2 | 2/2006 | Su-Tuan | |
| 7,051,389 | B2 | 5/2006 | Wassilefky | |
| 7,069,607 | B2 | 7/2006 | Nichols | |
| 7,083,486 | B2 | 8/2006 | Yeh | |
| 7,235,114 | B1 | 6/2007 | Minick et al. | |
| 7,279,058 | B2 | 10/2007 | Morgan | |
| 7,306,840 | B2 | 12/2007 | Brade-Scholz et al. | |
| 7,404,689 | B1 * | 7/2008 | Poling | A47G 27/0468 404/31 |
| 7,415,742 | B2 | 8/2008 | Wassilefsky | |
| 7,464,791 | B2 | 12/2008 | Cooksey et al. | |
| 7,530,127 | B2 | 5/2009 | Leifermann et al. | |
| 7,735,169 | B2 | 6/2010 | Wassilefsky | |
| 7,850,498 | B2 | 12/2010 | Yeh | |
| 7,976,933 | B2 | 7/2011 | Yeh | |
| 8,931,162 | B2 * | 1/2015 | Gonzalez | F16B 45/00 16/5 |
| 8,991,006 | B2 * | 3/2015 | Masanek, Jr. | B60N 3/048 428/167 |
| 2002/0092110 | A1 | 7/2002 | Blum et al. | |
| 2004/0013853 | A1 | 1/2004 | Mandzsu et al. | |
| 2004/0250346 | A1 | 12/2004 | Vasishth | |
| 2005/0101201 | A1 | 5/2005 | Yeh | |
| 2006/0046023 | A1 | 3/2006 | Clewell | |
| 2006/0086026 | A1 | 4/2006 | Ho et al. | |
| 2006/0134401 | A1 | 6/2006 | Yeh | |
| 2007/0110950 | A1 | 5/2007 | Yang | |
| 2007/0275827 | A1 | 11/2007 | Glaser | |
| 2008/0152860 | A1 | 6/2008 | Meyer | |
| 2008/0305304 | A1 | 12/2008 | Yeh | |
| 2009/0148666 | A1 | 6/2009 | Yeh | |
| 2009/0162579 | A1 | 6/2009 | McDuff | |
| 2009/0258179 | A1 | 10/2009 | Sudol et al. | |
| 2011/0052877 | A1 | 3/2011 | Yeh | |
| 2013/0198990 | A1 * | 8/2013 | Hawkins | A47L 23/266 15/215 |
| 2013/0298840 | A1 | 11/2013 | Mishan | |

FOREIGN PATENT DOCUMENTS

| | | | |
|---|---|---|---|
| GB | 2115693 | A | 9/1983 |
| JP | S57126887 | U | 8/1982 |
| JP | H0885180 | A | 4/1996 |
| JP | 2002337592 | A | 11/2002 |
| KR | 20060098189 | A | 9/2006 |
| TW | M434527 | U | 8/2012 |
| WO | 2008011708 | A1 | 1/2008 |

OTHER PUBLICATIONS

Extended European Search Report for European Application No. 22750282.0, mailed Jan. 24, 2025, 9 pages.

International Search Report and Written Opinion for International Application No. PCT/US2010/040821, international filing date of Jul. 1, 2010, mailed Feb. 28, 2011,9 pages.

International Search Report and Written Opinion for International Application No. PCT/US2022/014838, dated Apr. 26, 2022, 9 Pages.

* cited by examiner

TWO-PIECE MATS WITH DETACHABLE COVER AND BASE PAD PORTIONS

TECHNICAL FIELD

The present invention relates to improved two-piece mats comprising a top portion and a bottom portion. The two-piece mats of the invention may be used for a variety of outdoor and indoor applications.

BACKGROUND ART

Mats, such as doormats and bathmats, are typically made of carpet fibers or other fibrous material that is difficult to clean thoroughly or sanitize. When soiled, the mat must be scrubbed by hand or professionally cleaned like carpet, and may still be left with residue stains or soil marks and odor from food, drink or other liquid, dirt, mold, mildew, allergens, toxins, pet dander, pet or human vomit, urine, or other bodily fluids. The nature of a typical mat design and construction makes it time-consuming or costly to clean or replace, heavy and cumbersome to move, and nearly impossible to thoroughly clean. Professional cleaning may use toxic chemicals, and steam cleaning cannot reach deep in the fibers. This may be hazardous to children or animals who crawl or anyone who lies on the mat, or to any person sensitive to allergens, odors and toxins.

Typical mats are not designed to be laundered in a washing machine, cleaned thoroughly with soap and water or dry cleaned. Generally speaking, there are three types of conventional mats. The first type of conventional mats is similar to a heavy towel. This type of mat is washable, but its lack of a non-slip feature can be hazardous, particularly in wet environments such as the bathroom or outside in rainy or snowy climates. The second type of conventional mats has a fibrous and absorbent top and built-in non-slip backing on the bottom. Many manufacturers of the second type of mat claim that they are washable, but this type of mat typically starts falling apart once laundered in the washing machine, and starts losing chunks of loose fibers and bits of the non-slip backing. The third type of conventional mats are simply entirely or almost entirely made out of rubber or plastics. While such mats may not need to be laundered, they are also often not aesthetically pleasing and may not fit well with their surrounding environments and décor.

Moreover, the cumbersome, difficult and expensive nature of a typical mat prevents it from being versatile, e.g., it does not allow the owner to switch out the mat design seasonally or as desired or needed, as is often the case with bedding. Often, owners will keep a soiled mat longer than desired because of the inconvenience and expense of replacement. Typical mats are made with wool fiber that, in addition to trapping the above-mentioned stains and soil, can shed, be itchy and uncomfortable. Alternative mat options, such as mats made from natural fibers such as sisal, are rough and uncomfortable to walk, crawl or lie on, and are also heavy and difficult to clean. Mats made from plastics that are designed for outdoor use are washable with soap and water but are essentially all plastic and, therefore, uncomfortable and limited to a few basic designs.

Accordingly, there is a need for a mat that serves the purpose of a conventional mat, but is configured to enable the owner to separate a fabric cover material from a non-slip, non-absorbent mat material and wash both separately with minimal cost and inconvenience. Moreover, there is a need for a mat alternative that is lighter in weight, comfortable, versatile, flexible, bendable (more compact) and, therefore, less cumbersome to carry or move, and less prone to accumulation of dirt, dust, mold, mildew, pet dander, allergens, residual stains, pet or human vomit, urine, or other bodily fluids.

DISCLOSURE OF INVENTION

Summary of the Invention

In view of the aforementioned considerations, the present invention is directed to mats, such as doormats and bathmats, with a cover detachably fastened to a base pad by a releasable fastening means for mechanically interlocking the cover to the base pad.

When a mat of the present invention is mounted on a floor, the mat provides a cover with a first top surface which is visible and a first bottom surface which is hidden. The cover detachably fastens to a base pad providing thereon a second top surface and a second bottom surface, the first and second bottom surfaces being substantially planar. The second top and bottom surfaces of the base pad expose non-slip material for frictionally gripping both the first bottom surface of the cover and the exposed surface of the floor. A peripheral fastening arrangement on or in the top surface of the base pad detachably connects the base pad to the bottom surface of the cover. The peripheral fastening arrangement keeps the cover and the base pad connected until it is desired to separate the cover from the base. Consequently, when the cover and base pad are attached and lying on a floor, footsteps on the first top surface provided on the cover cause the first bottom surface of the cover to frictionally engage the second top surface on the base pad. Accordingly, during use of the mat on a floor, the cover does not slip relative to the base pad and the base pad does not slip relative to the floor. When the mat is due for cleaning or laundering, the cover is strippable from the base pad by applying a force that separates the fasteners.

In some embodiments, the cover is made from a durable, machine-washable fabric material.

In some embodiments, the cover is made from polyester or another material with attributes similar to polyester, including being resistant to shrinkage, wrinkling, and stretching and being washable and durable.

In some embodiments, the cover is made from cotton, microfiber, or other soft material typical of bathmats.

In some embodiments, the cover may be treated for stain resistance. For instance, the top surface of the cover may be coated with polyurethane, which provides a non-toxic stain resistant coating.

In some embodiments, the base pad is made from a synthetic or real rubber, or a similar material such as thermoplastic rubber (TPR) or soft plastics.

In some embodiments, the base pad comprises drainage tracks and/or drainage holes to allow water and other liquids to escape, which is particularly suitable for outdoor use. In other embodiments, the base portion does not have drainage tracks or drainage holes.

In some embodiments, mechanical snaps are used as fasteners for attaching the cover and the base pad. For instance, metal fabric snaps made up of male and female halves may be used.

In some embodiments, hook and loop material (such as Velcro) is used as the fastener for attaching the cover and the base pad. The hook and loop material may cover substantially all of the bottom surface of the cover and the corresponding top surface of the base pad. Alternatively, the hook and loop material may cover just a portion of these surfaces, such as corners or in a pattern over the surfaces. The skilled artisan will appreciate that wherever hook and loop material is used to attach two surfaces, it is typical that one surface will have one side of the hook and loop material (that is, having just hooks or just loops) and the other surface will have the other, corresponding side of the hook and loop material (that is, having loops to engage with the hooks on the other surface, or vice versa).

In some embodiments, both mechanical snaps and hook and loop material are used as fasteners for attaching the cover and the base pad.

In some embodiments, hook and loop material is used, in which one part of the material (such as the loop material) is attached in conventional fashion to the bottom surface of the cover pad (such as being sewn or glued) while the other part of the material (such as the hook material) is glued to mechanical fasteners that attach to the base pad.

A benefit of the invention is that a variety of cover designs and textures are selectable to combine with a variety of base pads to make mats of various aesthetic designs or mats for various purposes.

DETAILED DESCRIPTION

Referring now to FIG. 1, there is shown a top view of a cover 10. The cover 10 provides a first top surface 11 when the mat lies on the floor. The first top surface 11 may have an aesthetic design or a plain design. The first top surface 11 of the cover 10 may also be utilitarian when used for doormats, bathmats, kitchen mats, exercise mats, pet mats, yoga mats or any other kind of mat.

Referring now to FIG. 2, there is shown a bottom view of the cover 10, which presents a first bottom surface 21 of cover 10. The first bottom surface 21 has various fasteners 22 arranged around the surface. The fasteners 22 may be mechanical snaps (such as metal fabric snaps made up of male and female halves; in which case one of the halves may be used here), a portion of hook and loop material (e.g., loop material that would attach to corresponding hook material), or another type of fastener. In some embodiments, the bottom surface of the cover 21 may be in whole or in part covered with hook or loop material and not localized to specific spaces like the fasteners 22 shown in the figure. In some embodiments, different types of fasteners may be used on the bottom surface 21. For instance, the bottom surface may be entirely and partially covered in hook or loop material while still having mechanical snaps as the fasteners 22.

In some embodiments, the cover is made from a durable, machine-washable fabric material.

In some embodiments, the cover is made from polyester or another material with attributes similar to polyester, including being resistant to shrinkage, wrinkling, and stretching and being washable and durable.

In some embodiments, the cover is made from cotton, microfiber, or other soft material typical of bathmats.

In some embodiments, the cover may be treated for stain resistance. For instance, the top surfaces of the cover may be coated with polyurethane (or another coating) which provides a non-toxic stain or water-resistant properties.

Referring now to FIG. 3, there is shown a top view of a base pad 30. The base pad 30 provides a second top surface 31 that is configured to attach to the first bottom surface 21 of the cover 10. The second top surface 31 has fasteners 32 that correspond to fasteners 22 on the bottom surface 21 of the cover 10. For instance, if mechanical snaps are used, then fasteners 22 may be plugs and fasteners 32 may be sockets into which the plugs may be inserted (or vice versa). As another example, fasteners 22 and 32 may be corresponding portions of hook and loop material. The number, placement, size, and type of the fasteners 22 and 32 as discussed herein are not intended to be limiting.

In some embodiments, the base pad is made from a synthetic or real rubber, or a similar material such as thermoplastic rubber (TPR) or soft plastics.

In some embodiments, base pad 31 has drainage tracks 33. Although drainage tracks are shown, the base pad may also, or instead, have drainage holes arranged across the pad (drainage holes are illustrated in FIGS. 7-8). The function of the drainage tracks or holes is to allow liquids to escape instead of pooling on the cover 10 when the cover is attached to the base pad. This is particularly useful in wet environments such as where a mat is used outdoors in rainy or snowy weather. Mats intended for use indoors may omit drainage tracks and holes.

Referring now to FIG. 4, there is shown a bottom view of a base pad 30. The base pad provides a bottom surface 41 which is the surface that comes in direct contact with the floor when the mat is in ordinary use. As shown here, in some embodiments, the bottom surface may have a non-slip surface created by fashioning a textured pattern 42 onto the surface. The textured pattern helps increase the friction between the bottom surface 41 and the floor. In some embodiments, the bottom surface 41 may be fashioned out of material that naturally provides an acceptable degree of slip resistance; in such cases, the textured pattern 42 may not be necessary.

Referring now to FIG. 5, there is shown a top view of the complete mat assembly, comprising a cover 10 attached to a base pad 30. FIG. 6 shows a side cross-sectional view of a portion of the complete mat assembly. This view shows that the top surface 31 of the base pad 30 is actually the top surface of a recessed cavity of the base pad, in which vertical surface 61 forms one of the vertical walls of the cavity. The cover 10 is placed into the recessed cavity of the base pad, and fastener 22 of cover 10 is attached to fastener 32 (the top of which could have hook material, or another type of fastener) of base pad 30, holding the cover and base pad together. As described above, the bottom surface of the cover 21 may be in whole or in part covered with hook or loop material rather than having fasteners 22; in this case, then the portions covered with hook or loop material would attach to fasteners 32 that are covered with the corresponding loop or hook material. The textured pattern 42 provides ridges on the bottom surface 41 of the base pad, which increases friction between the bottom surface and the floor.

As is seen in FIG. 6A where the mat 50 is shown in cross-section, it is seen that when the rug 50 is assembled and on the floor, foot pressure represented by the arrow 62, is transmitted through the cover 10 to the top surface 31 of the base pad 30. This causes the cover 10 to frictionally adhere to the base pad 30 so that the cover 10 does not slip with respect to the base pad 30. The same foot pressure force 62 is transmitted from the top surface 31 of the base pad 30 to the bottom surface 41 of the base pad 30 so that the bottom surface 41 of the base pad 30 frictionally engages the surface of the floor. Consequently, the base pad 30 and the cover 10 help prevent slippage with respect to one another and with respect to the floor. Consequently, the mat 50 does not slip with respect to the floor.

When it is desired to separate the cover 10 from the base pad 30 in order to launder the cover 10 and/or manually clean the base pad 30, the cover 10 is stripped from the base pad 30 by simply grasping the cover 10 in one hand and the base pad 30 in the other and pulling them apart to separate the cover from the fasteners 32 on the base pad. The cover 10 may then be separately laundered in a washing machine or otherwise cleaned. The base pad 30 may be cleaned separately with a non-bleach household cleanser or soap and water.

It may be desired to switch or replace the cover 10 so as to have a new design of the cover 10 as the seasons change, to provide the environment with a fresh look, or to simply replace the old cover with a new cover. This feature is accommodated by having a plurality of interchangeable covers 10 for each base pad 30.

FIG. 6B shows an embodiment in which, rather than using corresponding fasteners 22 and 32, respectively disposed on the cover and the base pad, the cover is covered with a hook or loop material, and corresponding material is attached to the base pad via a structure comprising parts 90 and 100 as further described below in connection with FIG. 7-13.

FIG. 7 shows a top view of a base pad 70 and FIG. 8 shows a bottom view of base pad 70. The base pad 70 provides a second top surface 71 that is configured to attach to the first bottom surface 21 of the cover 10, as well as a second bottom surface 81 for resting on top of the ground or other surface. The base pad 70 has a series of holes 72 going through its second top surface 71 and second bottom surface 81. This base pad 70 is shown with a series of drainage holes 73 arranged across the pad to allow for water to escape.

FIG. 9 shows multiple views of the top half of a fastener 90 according to an embodiment. FIG. 9A shows a top view of the outer portion 91 of the fastener 90, to which is affixed a portion of a hook and loop material 92, such as a hook material. The material 92 (e.g., hook material) is intended to attach to the corresponding material (e.g., loop material) affixed to the bottom surface 21 of the cover 10. FIG. 9B shows a side view of the fastener 90 and FIG. 9C shows a bottom perspective view of the inner portion of the fastener 90. The fastener 90 includes a socket 94 on its inner portion 93.

FIG. 10 shows multiple views of the bottom half of a fastener 100 according to an embodiment. FIG. 10A shows a top view of the outer portion 101 of the fastener 100, which is intended to touch the ground; it may be plain or optionally embossed with branding or ornamentation. FIG. 10B shows a side view of the fastener 100 and FIG. 10C shows a top perspective view of the inner portion of the fastener 100. The fastener 100 includes a plug 104 on its inner portion 103. The plug 104 fits snugly into the socket 94, allowing the two halves of the fastener 90 and 100 to be attached.

FIG. 12 shows a top view of a base pad 70 and FIG. 13 shows a bottom view of base pad 70 in which the fasteners 90 and 100 have been attached through each of the holes 72 (see FIGS. 7 and 8). The outer portion 91 of each fastener 90, on which is affixed a portion of hook material, is exposed on the top surface of the base pad 70 for attachment to the bottom surface 21 of the cover 10. The outer portion 101 of each fastener 100 is oriented toward the bottom of the base pad 70. The fasteners 90 and 100 are locked through each hole 72 and do not readily detach, though they may be detached intentionally by a user, such as for cleaning or replacement. The use of these fasteners addresses challenges associated with reliably affixing hook material (or any other material use for fastening) to the base pad 70, which may be made from a synthetic or real rubber, or a similar material such as thermoplastic rubber (TPR) or soft plastics. This solution is also easier for users to maintain as well as being less wasteful. When the hook material gets dirty or old, users would need to replace just the fasteners comprised of a plug and socket rather than the whole base pad.

From the foregoing description, one skilled in the art can easily ascertain the essential characteristics of this invention, and without departing from the spirit and scope thereof, can make various changes and modifications of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding embodiments are illustrative and not limiting of the scope of the invention.

Figure 1:
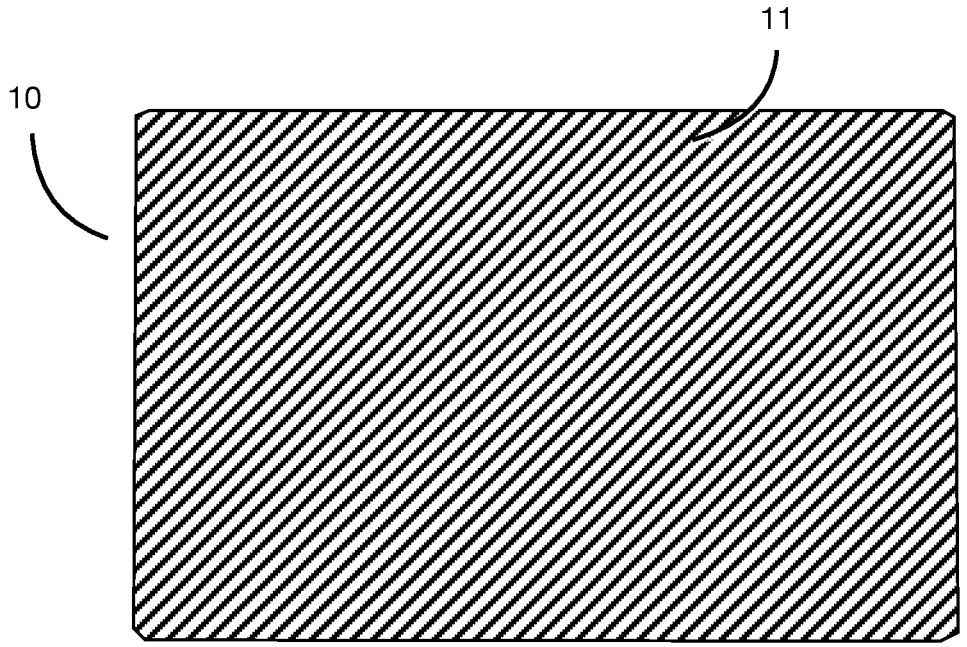
FIG. 1 is a top view of a cover according to an embodiment.
Figure 2:
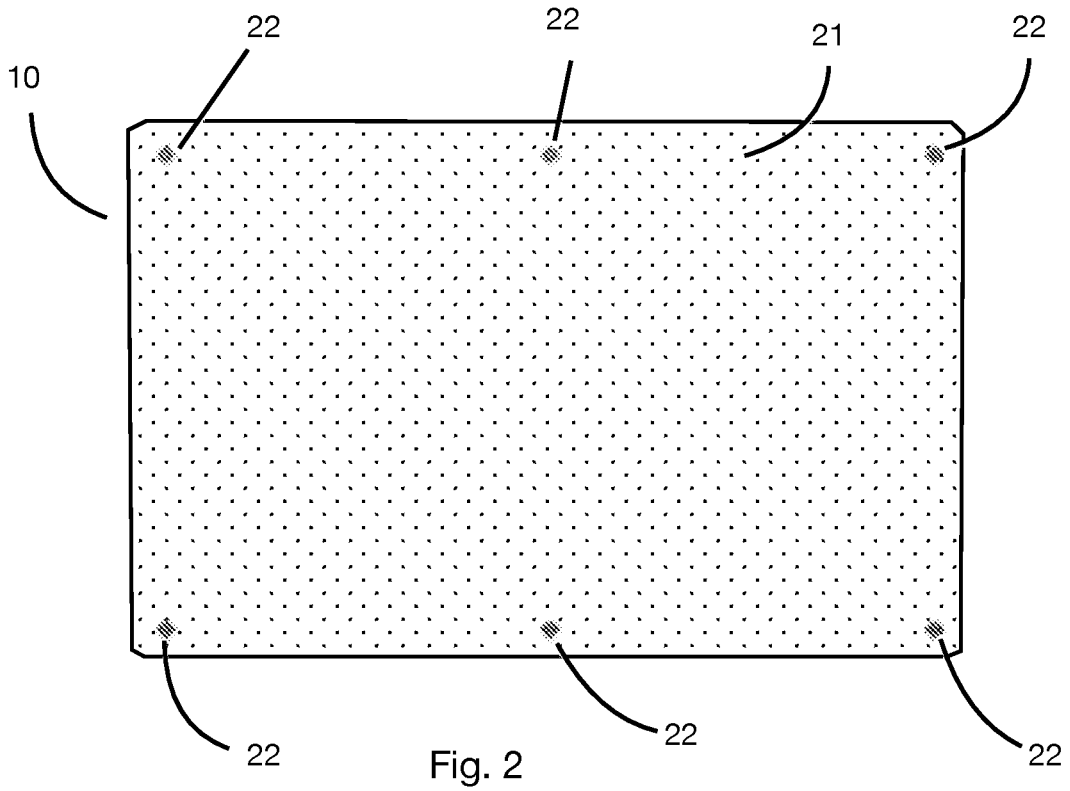
FIG. 2 is a bottom of a cover according to an embodiment.
Figure 3:
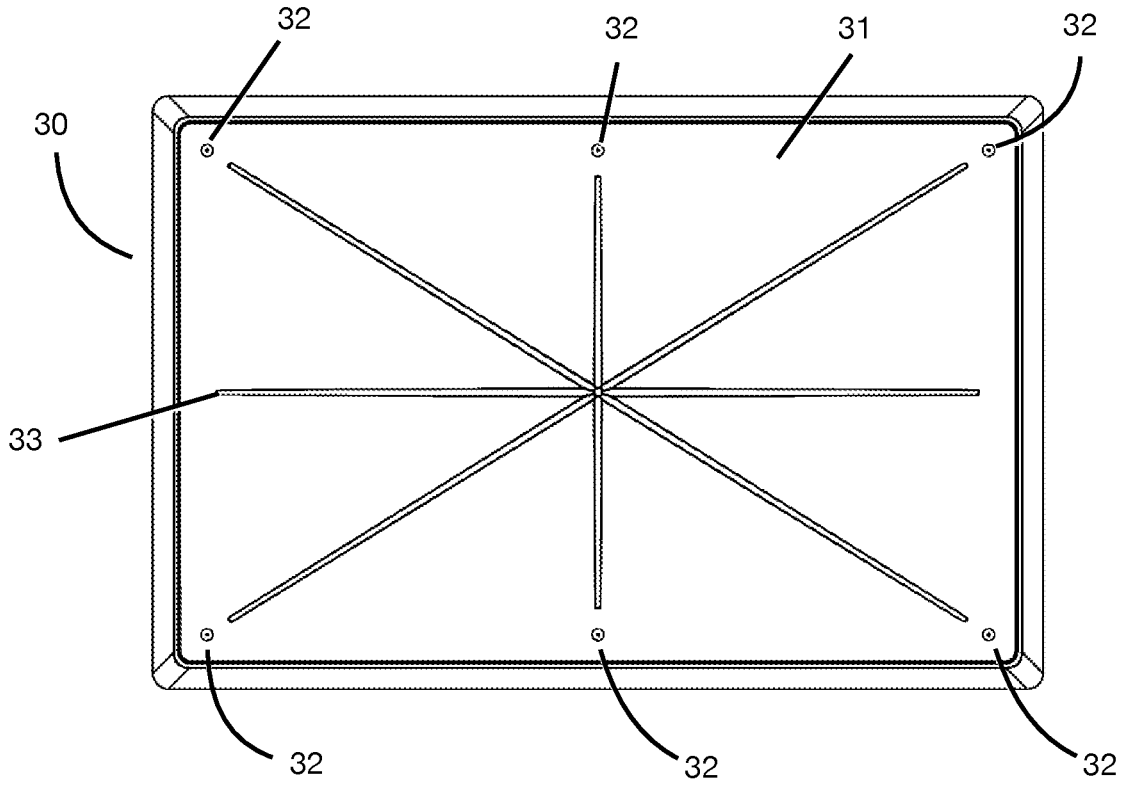
FIG. 3 is a top view of a base pad according to an embodiment.
Figure 4:
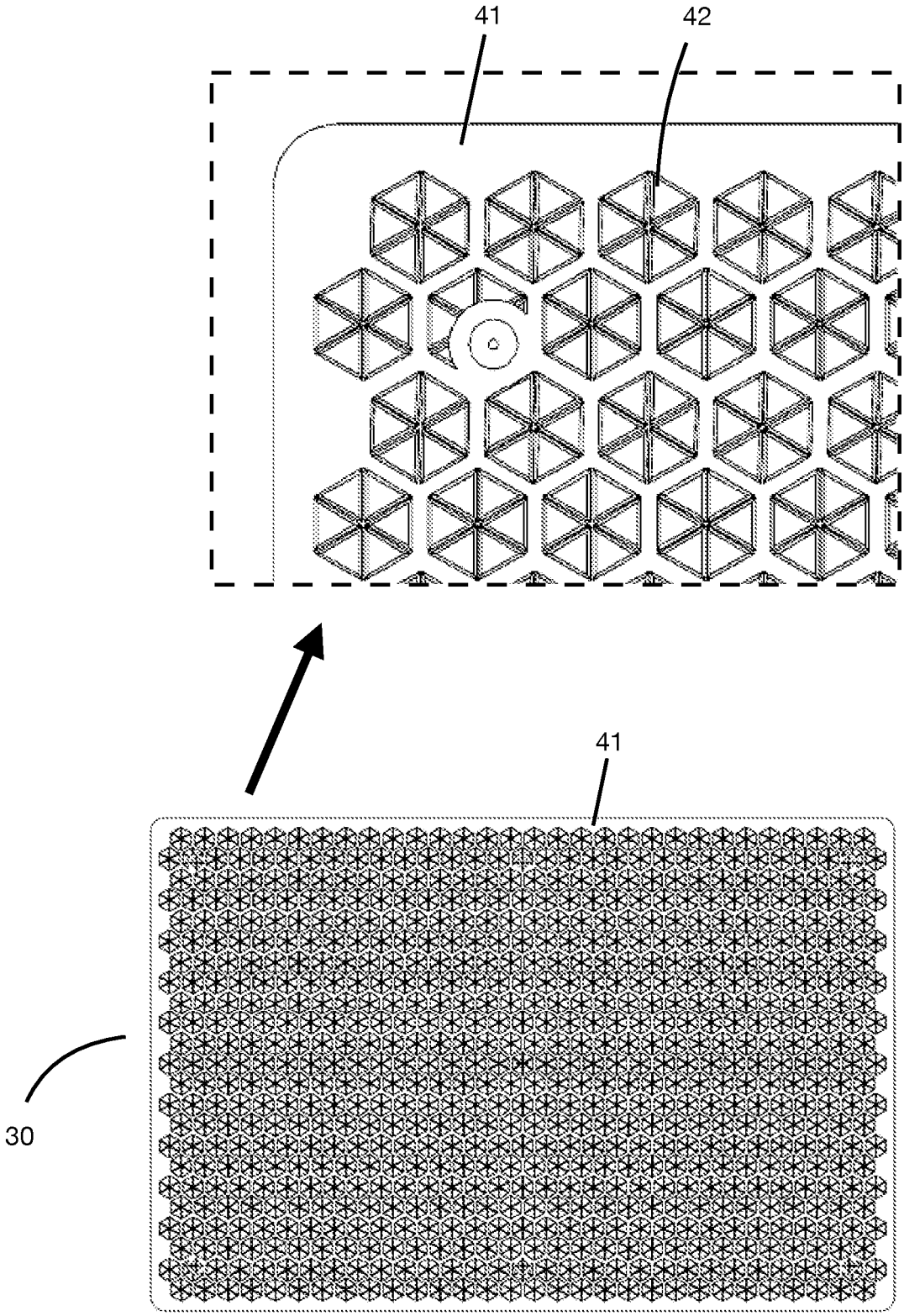
FIG. 4 is a bottom view of a base pad according to an embodiment.
Figure 5:
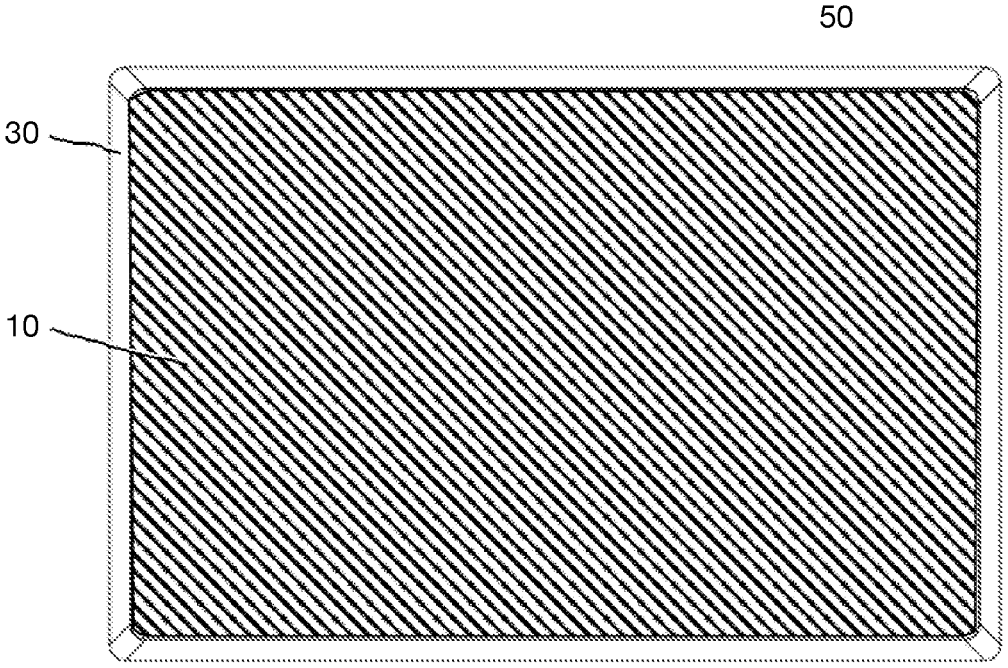
FIG. 5 is a top view of a mat comprising a cover attached to a base pad according to an embodiment.
Figure 6A:
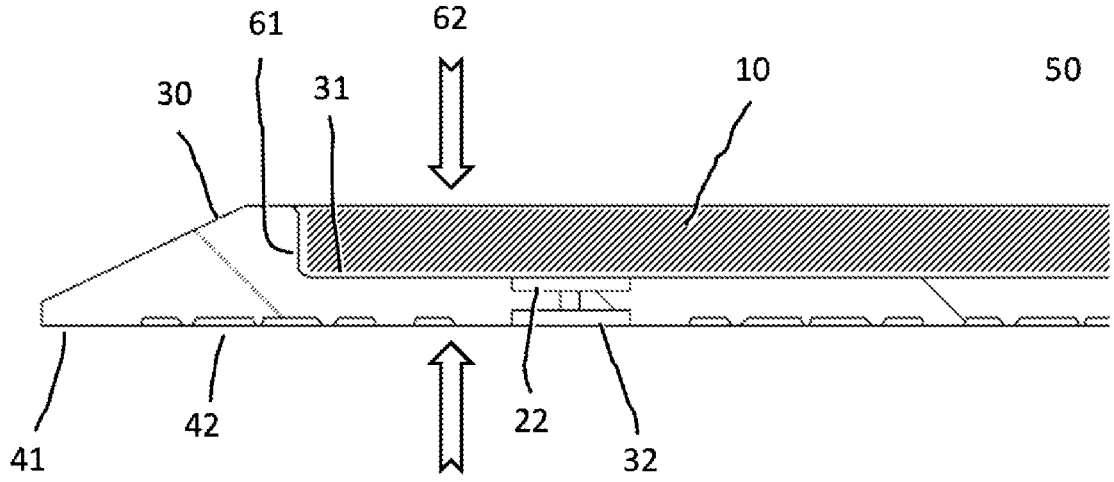
FIG. 6A is a side view of a mat comprising a cover attached to a base pad according to an embodiment.
Figure 6B:
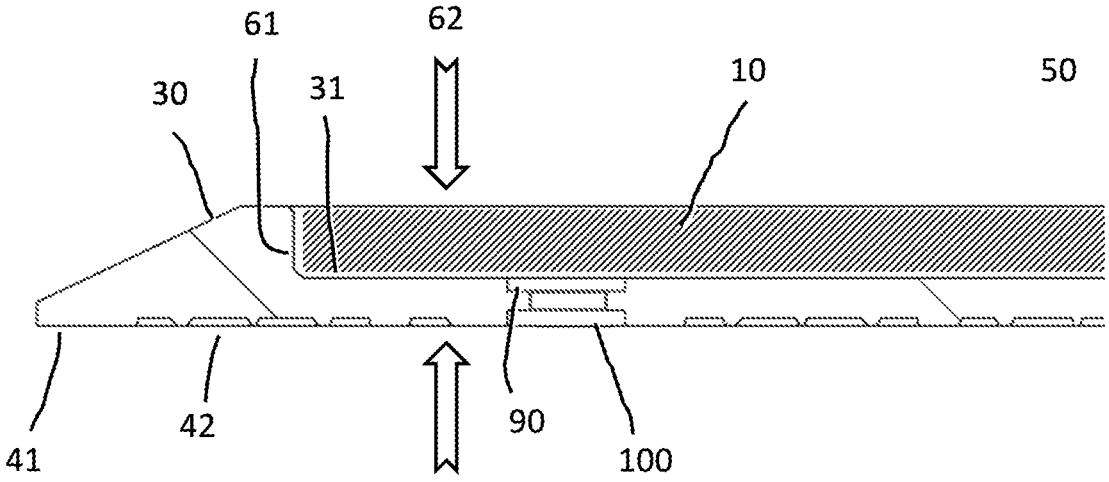
FIG. 6B is a side view of a mat comprising a cover attached to a base pad according to an embodiment.
Figure 7:
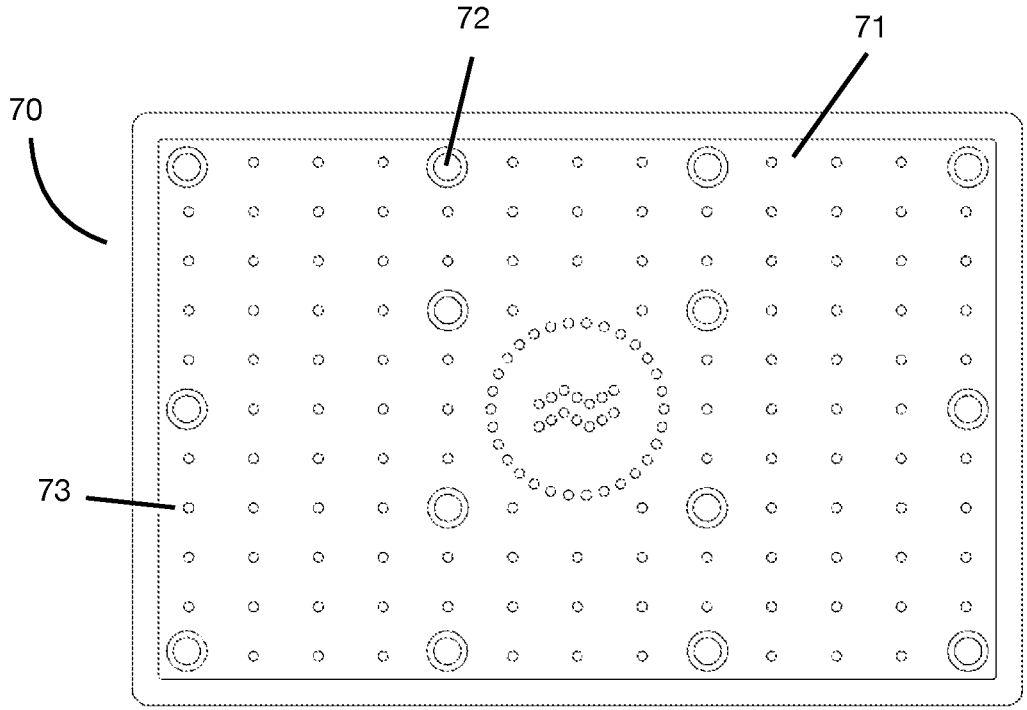
FIG. 7 is a top view of a base pad according to an embodiment.
Figure 8:
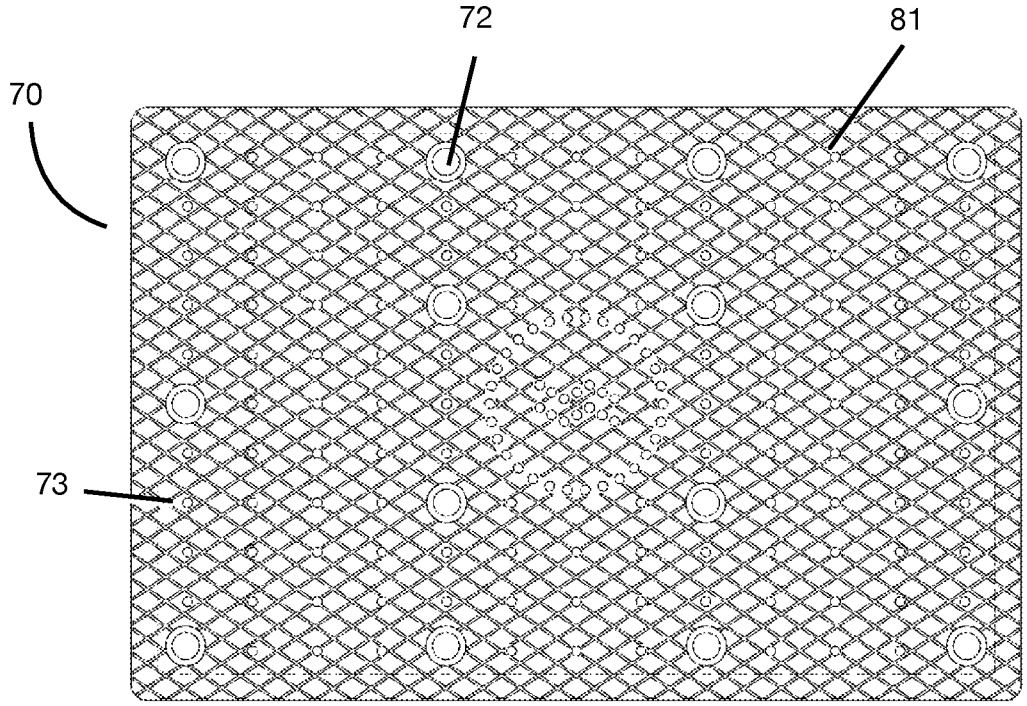
FIG. 8 is a bottom view of a base pad according to an embodiment.
Figure 9A:
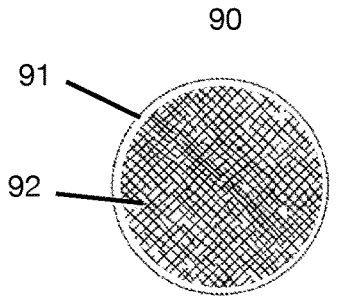
FIG. 9 shows multiple views of the top half of a fastener according to an embodiment.
Figure 9B:
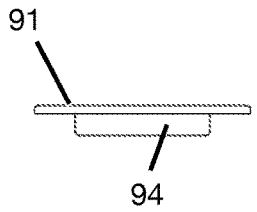
Figure 9C:
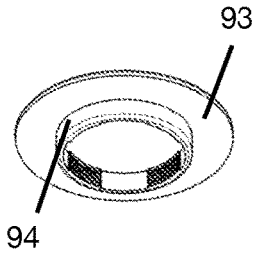
Figure 10A:
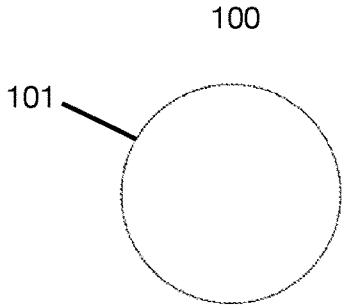
FIG. 10 shows multiple views of the bottom half of a fastener according to an embodiment.
Figure 10B:
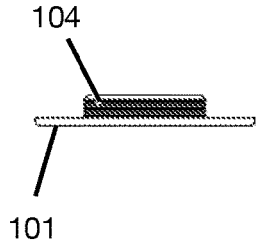
Figure 10C:
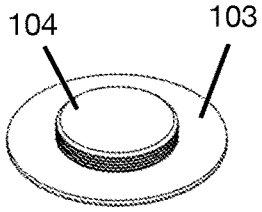
Figure 11:
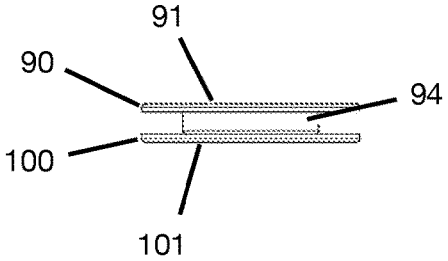
FIG. 11 shows a side view of the top half and bottom half of a fastener attached to each other.
Figure 12:
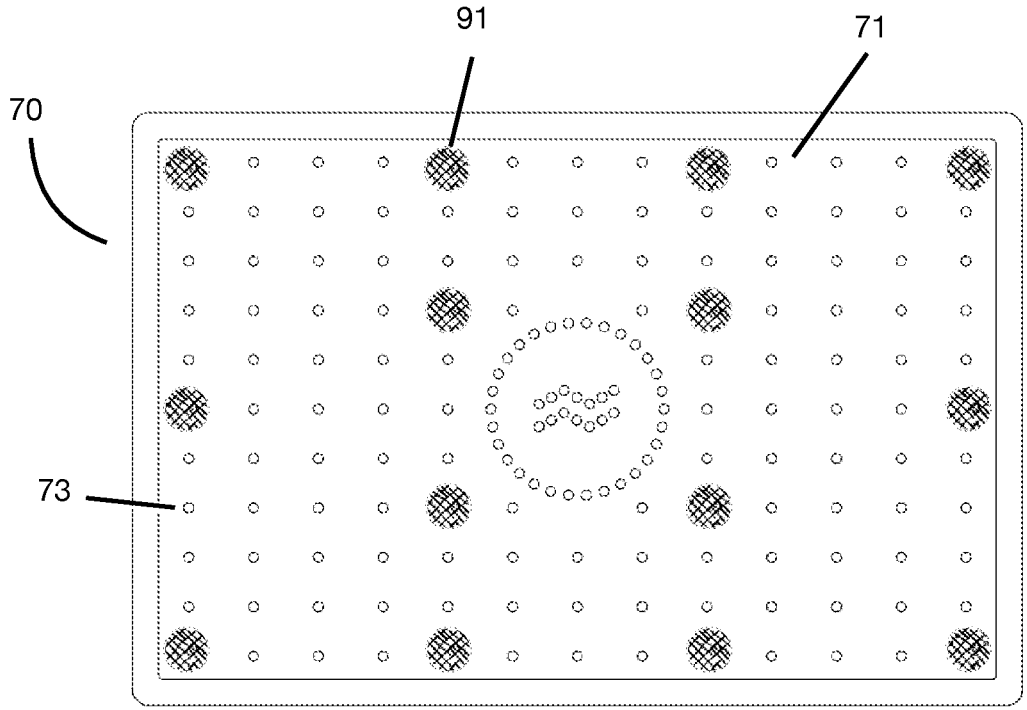
FIG. 12 is a top view of a base pad according to an embodiment, in which fasteners have been attached.
Figure 13:
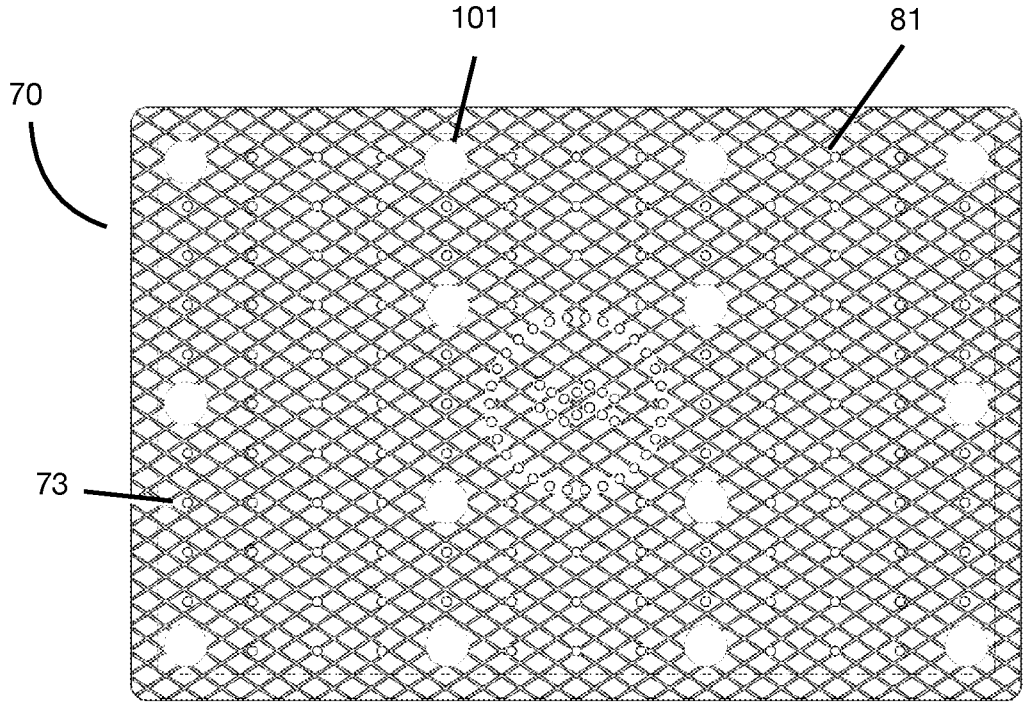
FIG. 13 is a bottom view of a base pad according to an embodiment, in which fasteners have been attached.

The invention claimed is:

1. A two-piece mat, comprising:

a cover comprising:

a first top surface, and a first bottom surface comprising a first arrangement of fasteners, wherein the cover is made of a machine-washable material that is porous to liquids;

a base pad made of a non-porous material, comprising:

a second top surface comprising a second arrangement of fasteners that may be affixed to the first arrangement of fasteners to releasably attach the cover to the base pad, a second bottom surface, and one or more drainage openings through the base pad;

wherein liquids may seep through the cover onto the base pad, and subsequently drain through the drainage openings;

wherein each fastener of the second arrangement of fasteners comprises a top part and a bottom part locked together through a hole in the base pad;

wherein the top part of each fastener of the second arrangement of fasteners comprises a top cap with a top outer portion that sits substantially flush with the second top surface of the base pad, and a top inner shaft that is narrower than the top cap;

wherein the bottom part of each fastener of the second arrangement of fasteners comprises a bottom cap with a bottom outer portion that sits substantially flush with the second bottom surface of the base pad, and a bottom inner shaft that is narrower than the bottom cap;

wherein the top inner shaft and the bottom inner shaft may be interlocked with each other through the hole in the base pad to secure the fastener to the base pad;

wherein the hole in the base pad is narrower than the top cap and the bottom cap of the fastener; and wherein a first side of a hook and loop material is affixed to the top outer portion.

2. A two-piece mat, comprising:

a cover comprising:

a first top surface, and a first bottom surface comprising a first arrangement of fasteners in the form of a first side of a hook and loop material, wherein the cover is made of a machine-washable material that is porous to liquids;

a base pad made of a non-porous material, comprising:

a second top surface comprising a second arrangement of fasteners affixed to the second top surface, wherein the second arrangement of fasteners may be interlocked to the first arrangement of fasteners to releasably attach the cover to the base pad, a second bottom surface, and one or more drainage openings through the base pad;

wherein liquids may seep through the cover onto the base pad, and subsequently drain through the drainage openings;

wherein each fastener of the second arrangement of fasteners comprises a top part and a bottom part locked together through a hole in the base pad;

wherein the top part of each fastener of the second arrangement of fasteners comprises a top cap with a top outer portion that sits substantially flush with the second top surface of the base pad, and a top inner shaft that is narrower than the top cap;

wherein the bottom part of each fastener of the second arrangement of fasteners comprises a bottom cap with a bottom outer portion that sits substantially flush with the second bottom surface of the base pad, and a bottom inner shaft that is narrower than the bottom cap;

wherein the top inner shaft and the bottom inner shaft may be interlocked with each other through the hole in the base pad to secure the fastener to the base pad;

wherein the hole in the base pad is narrower than the top cap and the bottom cap of the fastener; and wherein a second side of the hook and loop material is affixed to the top outer portion of each fastener.

3. The two-piece mat of claim 2, further characterized in that the second side of the hook and loop material is secured to the top outer portion of each fastener using weatherproof adhesive.

* * * * *